United States Patent [19]

Kazor et al.

[11] Patent Number: 4,480,747

[45] Date of Patent: Nov. 6, 1984

[54] STATIC SHIELDED SHIPPING CONTAINER

[75] Inventors: Thomas R. Kazor, Chandler; Jon P. Whitcomb, Phoenix, both of Ariz.

[73] Assignee: Motorola, Inc., Schaumburg, Ill.

[21] Appl. No.: 509,475

[22] Filed: Jun. 30, 1983

[51] Int. Cl.[3] ..... B65D 81/14; B65D 85/30

[52] U.S. Cl. ..... 206/334; 206/328; 206/521; 206/524.3; 361/212; 361/220

[58] Field of Search ..... 206/328, 334, 521, 524.3, 206/454; 361/220, 212

[56] References Cited

U.S. PATENT DOCUMENTS

| | | | |
|---|---|---|---|
| 4,037,267 | 7/1977 | Kisor | 361/220 |
| 4,084,210 | 4/1978 | Forrest | 361/212 |
| 4,160,503 | 7/1979 | Ohlbach | 206/328 |
| 4,171,049 | 10/1979 | Nohara et al. | 206/328 |
| 4,211,324 | 7/1980 | Ohlbach | 206/328 |
| 4,241,829 | 12/1980 | Hardy | 206/328 |
| 4,293,070 | 10/1981 | Ohlbach | 206/328 |
| 4,308,953 | 1/1982 | Cohen | 206/334 |
| 4,355,719 | 10/1982 | Hinds et al. | 206/334 |
| 4,359,157 | 11/1982 | Horstmann | 206/328 |
| 4,427,114 | 1/1984 | Howell et al. | 206/328 |

*Primary Examiner*—William T. Dixson, Jr.
*Assistant Examiner*—Brenda J. Ehrhardt
*Attorney, Agent, or Firm*—Robert M. Handy

[57] ABSTRACT

An improved electrostatic shielded handling, shipping, and storage container is obtained by providing two separable container portions, each coated one-side only with a conductive layer. The lower container portion is coated only on its outer surface and the upper container portion is coated only on its inner surface. The two portions engage so that the upper portion slides over the lower portion bringing the two conductive layers into electrical contact so that objects placed within the container are completely surrounded by a conductive cage. The outer top and sides of the assembled container are free of any conductive coating so as to be available for decorative printing and/or identification marks. The conductive coating is exposed on the bottom surface of the assembled container, which insures that the conductive shield cage is grounded to any conductive object on which the container is placed.

4 Claims, 3 Drawing Figures

STATIC SHIELDED SHIPPING CONTAINER

BACKGROUND OF THE INVENTION

1. Field of the Invention

This invention relates in general to containers for handling, storing, and shipping charge sensitive electronic devices and, more particularly, to an improved container for handling, storing, and shipping semiconductor components requiring static charge protection.

2. Description of the Prior Art

It is well known that semiconductor devices, particularly metal-oxide-semiconductor devices are charge sensitive, that is, they can be readily damaged by static electric charge build-up during shipping, handling, and storage. Static electricity originates in a variety of different ways but most commonly by movement of persons or containers in which the devices have been placed so that when the devices or containers are touched, a charge is transferred from the person or the container to the device, resulting in critical damage to one or more of the sensitive components.

One conventional solution to this problem is to insert the terminals of the device in a piece of conductive foam for handling, shipping, and/or storage. The conductive foam maintains all of the terminals of the device at the same potential. Another solution is to use a conductive material as a part of the handling, storage, or shipping container itself. Typically, either the interior, or the exterior, or both interior and exterior surfaces of the container are coated with a conductive material, as for example, a carbon loaded ink or metal foil.

While such conductively coated containers have proved useful in suppressing static electricity damage, they suffer from a number of deficiencies of great practical significance. For example, those containers which are coated only on the inside provide electrical contact to the device themselves, but allow static electricity to build up on the outside of the container. Those which are coated only on the outside, while providing a conductive surface which is readily grounded, may allow static electricity to build up on the inside of the container. Additionally, the presence of a conductive coating on the outside of the container interferes with marking and labelling. For example, the typical carbon loaded conductive inks are black and it is more difficult and/or expensive to use the black conductive surface for marking, labelling, or advertising purposes. Those containers which are coated on both inside and outside are more expensive to produce because they require twice the amount of conductive ink plus additional labor, and they are still more difficult to mark and label than containers with uncoated outer surfaces. Further, most one-side coated containers can only be accessed by means of a flap which is an integral part of the package. Most two-sided coated containers used today are in the form of a tube or rail within which the electronic devices are stacked end-to-end.

Accordingly, it is an object of the present invention to provide an improved design for a static shielded container which permits greater flexibility in container configuration.

It is a further object of the present invention to provide an improved static shielded container which uses the minimum amount of conductive ink or coating.

It is an additional object of the present invention to provide an improved static shielded container which can be divided into two separable portions for easy loading and unloading, yet when reassembled provides a static electric shield completely surrounding the electronic components placed within.

It is a further object of the present invention to provide an improved static shielded container in which the outside surface of the bottom is conductive so that the container shield as a whole is readily brought to earth potential.

It is a still further object of the present invention to provide an improved static shielded container in which the top and/or sides are free of conductive material so as to be more adaptable to printing, marking, and labelling.

SUMMARY OF THE INVENTION

The above and other objects and advantages are achieved in accordance with the present invention where there is provided an improved static shielded container comprising a lower portion having thereon a conductive coating on its exterior surface, and an upper portion having a conductive coating on its inner surface, the upper portion being designed so as to fit partially over the lower portion so that the conductive coating on the outside of the lower portion is in electrical contact with the conductive coating on the inside of the upper portion. The two conductive coatings join to form a continuous conductive layer or cage surrounding the contents of the container. The two portions of the container can be formed from material which is conductive only on one side. The conductive coating exposed on the lower outside surface of the container grounds the static shield to any conductive object on which the container is placed. When inverted the objects within the container are in direct contact with the inner portion of the conductive layer or cage. The exterior top and sides of the container are free of conductive paint, ink, or coating, and are available for advertizing, identification, display matter, and/or notices without interference from the usual black conductive layer.

DETAILED DESCRIPTION OF THE DRAWINGS

Figure 1:
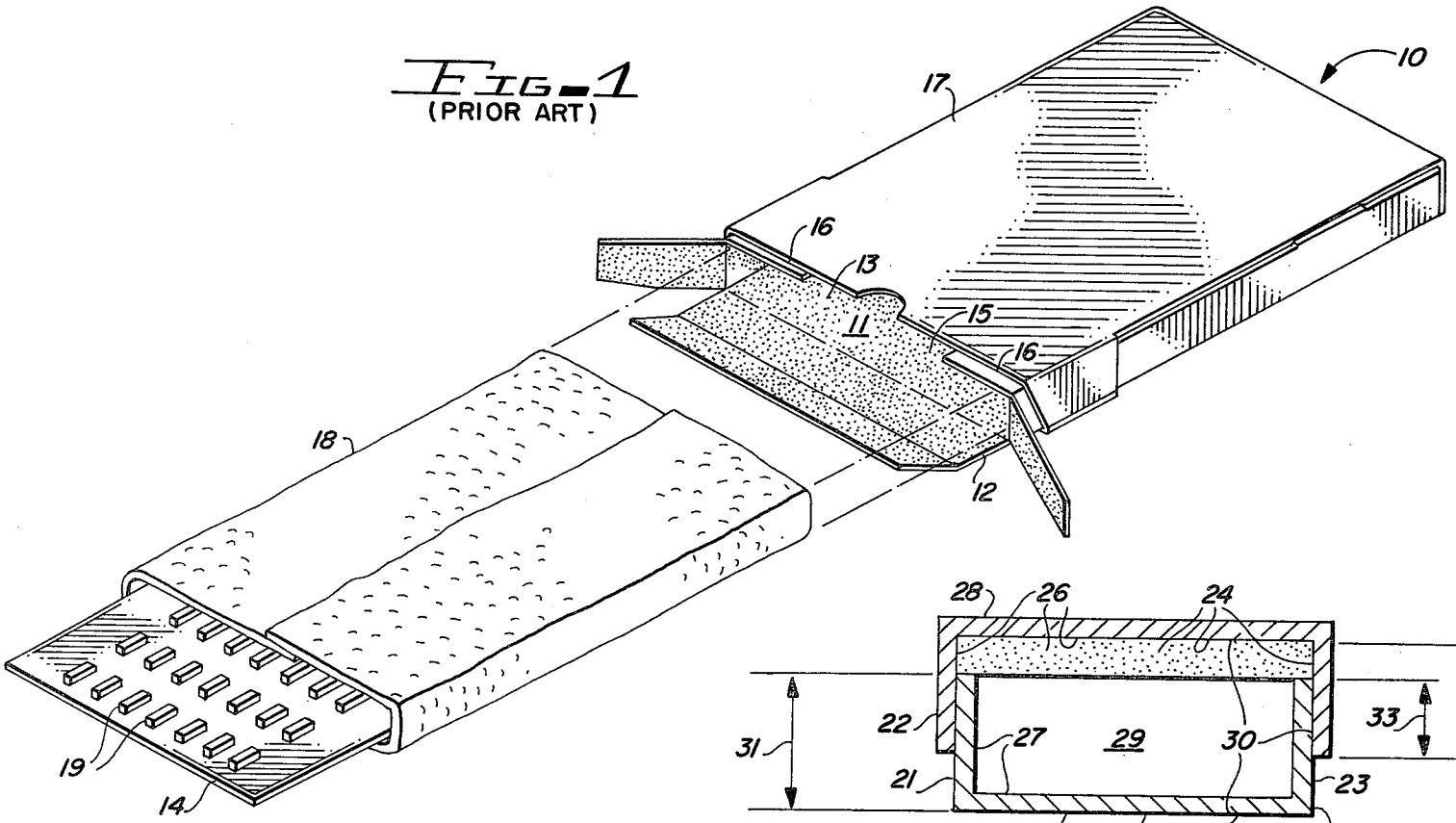
FIG. 1 (PRIOR ART)
FIG. 1 is a perspective view of a typical shielded shipping container according to the prior art.

FIG. 1 illustrates a prior art static shielded container or box 10 of one piece paper-board or cardboard having six walls, including openable end wall or flap 12, which provide interior cavity 11 into which electronic component or components 14 can be inserted. In the example of FIG. 1, electronic components 14 have the form of either a foam pad in which a large number of individual components 19 have been placed, or alternatively, an interconnected circuit board assembly. Electronic components 14 are frequently wrapped in antistatic cushioning foam or plastic blanket 18 before insertion into container 10.

Surface 13 constituting the inside of box 10 surrounding cavity 11, is typically coated with conductive carbon black layer or coating 15, denoted in FIG. 1 by stippling. Coating 15 is applied to the paper or cardboard box material prior to its being cut and folded to form box 10. Coating 15 is generally applied by a printing process. Usually, only one side of the box material is coated, since two-sided coating adds substantially to the cost. Strengthening flaps 16 are conveniently provided so that the box may be folded into shape. Exterior surface 17 of box 10 and strengthening flaps 16 are not coated with conductive material. Once electronic components 14 are placed inside box 10 and flap 12 closed, components 14 are completely surrounded by conductive carbon black coating 15.

The prior art design, as illustrated in FIG. 1, has a number of deficiencies, for example; first, the container is made of one piece of material, closed by a flap which forms one or more walls of the container itself. This arrangement increases the cost of loading the container since it cannot be separated cleanly into two portions. Second, while the electronic components placed within the container are surrounded by and in contact with their static shield, the shield layer cannot be externally grounded since it is entirely on interior surface 13 of box 10. While some of these deficiencies may be avoided by using double-side coated materials, this adds substantially to the cost.

Figure 2B:
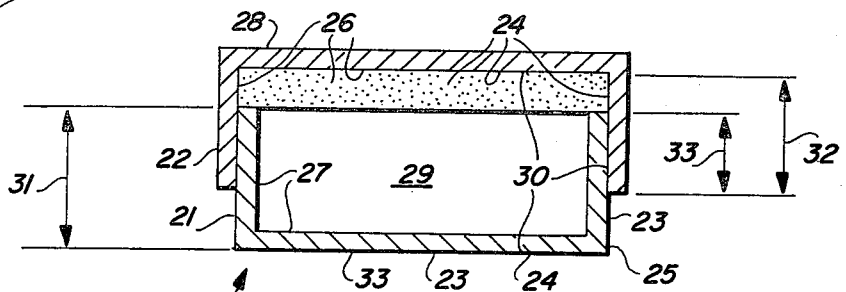
FIG. 2B is a cross-sectional view of the container of FIG. 2A.
Figure 2A:
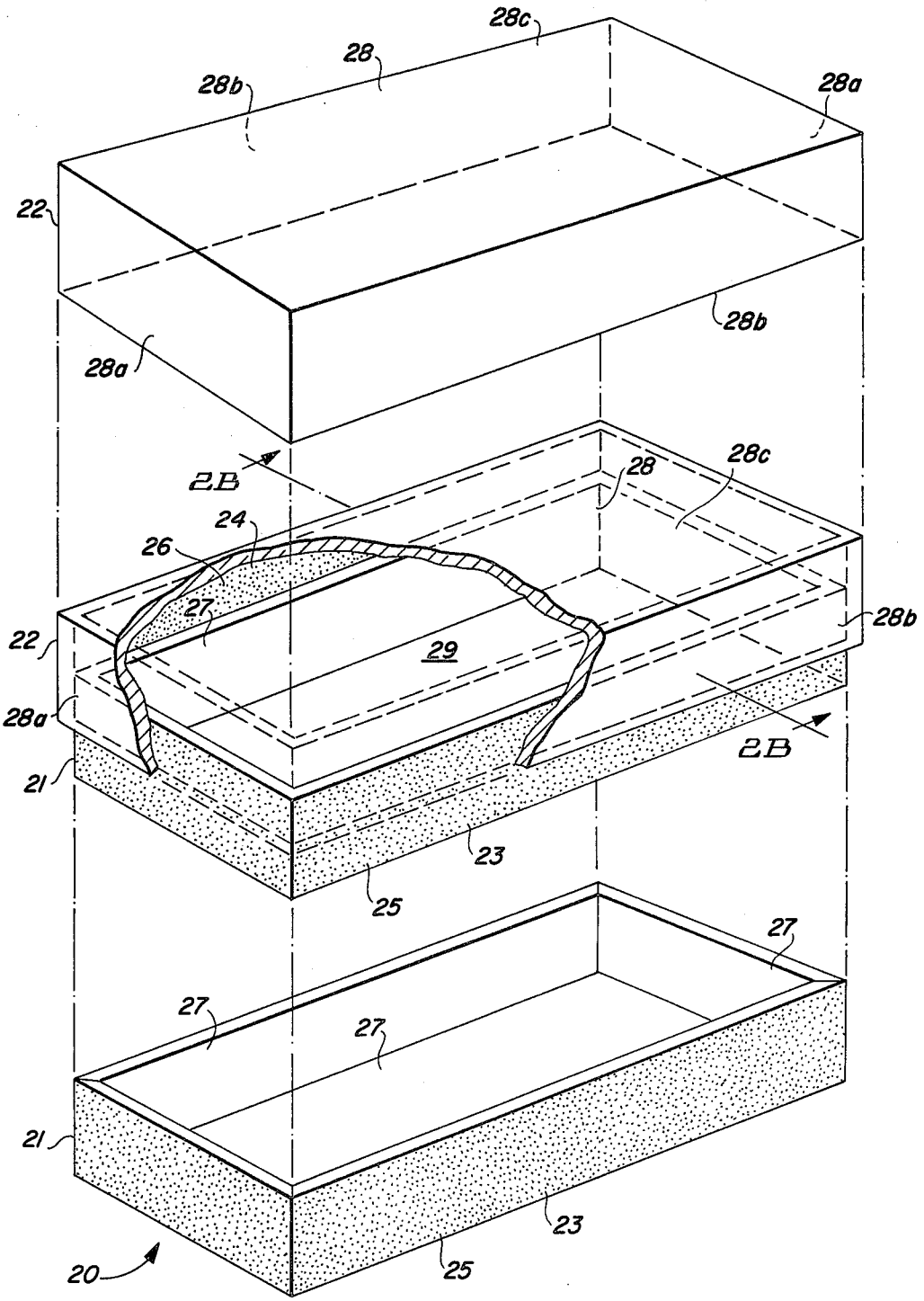
FIG. 2A is a perspective view, partially cut away and exploded, of an improved static shielded handling, shipping, and storage container according to the present invention.

FIG. 2A is a perspective view, partially cut away and exploded, of an electrostatic shielded storage and shipping container, according to the present invention. FIG. 2B is a cross-section through FIG. 2A. FIGS. 2A-B show electrostatic shielded handling, shipping, and storage container 20, wherein lower part or half 21 and upper part or half 22 are designed to slide together. Lower part 21 and upper part 22 separate when pulled apart, as shown by the exploded portion in FIG. 2A. In FIGS. 2A-B, lower part 21 and upper part 22 are also shown partially engaged.

Lower part 21 has conductive coating 23, indicated by the stippling in FIG. 2A, on outer or outward facing surface 25. Upper part 22 has conductive coating 24, indicated by the stippling on FIG. 2A-B, on inner or inward facing surface 26. The other surfaces of container 20, that is, inner surface 27 of lower part 21 and outer surface 28 of upper part 22, are substantially free of conductive coating. When lower part 21 and upper part 22 are engaged, for example slid one over the other as shown in FIGS. 2A-B, conductive coatings 23 and 24 are in contact, so that objects placed at 29 inside container 20 are completely surrounded by conductive layer 30 formed from the interconnection of separate layers 23 and 24.

Conductive layer 30 provides what is called a Faraday Cage, that is, a completely closed conductive shield. It is well known that such a cage prevents build-up of externally generated electric charge in its interior. Thus, objects placed at 29, interior to container 20, are shielded, that is, protected from external static charge build-up or discharges during handling, storage, and/or shipping.

As can be seen in FIGS. 2A-B, the container material of lower and upper parts 21, 22 need only be conductive on one side. This is a significant advantage. For example, parts 21, 22 of container 20 can be formed from one-side coated material. Additionally, outer surface 28 of upper part 22 is free from any conductive coating. This is important because conductive coatings are frequently made of carbon compounds and are black, so they interfere with effective use of the container surfaces for locating identifying numbers, address labels, advertising or commercial logos, eye-catching displays or warning symbols, and the like. It is preferable that sides **28*a-b* and top 28*c* of upper part 22 be free of any conductive coating so that they can be used for these purposes without interference. The invented configuration, as illustrated in FIGS. 2A-B provides this feature. By making side height 32 of upper part 22 equal or greater than side height 31 of lower part 21, only bottom surface portion 33 of conductive layer 30 is visible from outside the container. Hence, the often unsightly black conductive coating is substantially concealed from view when the closed container is in an upright position on a surface, even though bottom surface portion 33** is still in contact with the surface on which it is placed.

Having bottom surface portion 33 of conductive layer 30 available for contact is a substantial advantage, in that it automatically grounds conductive layer 30 of container 20 to any grounded conductive object on which container 20 is placed. Since most commercial storage racks, handling systems, and work tables are conductive or use conductive surfaces, this feature insures that the electrostatic shield, formed by conductive layer 30, will be at the same electrical potential as its surroundings. It should be noted that this feature is not possessed by most prior art electrostatic shielded handling, storage, and shipping containers. For example, in FIG. 1, conductive coating or layer 15 is entirely interior to container 10. Accordingly, a potential difference can exist between interior coating 15 and any conductor on which container 10 is placed. This is undesirable since the electrostatic shield will then not ordinarily assume ground potential.

In a typical embodiment of the present invention, container 20 is formed of corrugated paper box material coated with a conductive carbon ink. The box material is a dielectric material whose surface is made conductive by the presence of the conductive ink or other coating. Conductive carbon coated paper box materials are readily available commercially, for example, from Louisiana Pacific Fiberboard Corporation of Phoenix, Arizona.

Lower part 21 and upper part 22 are die-cut from flat sheets of one-side coated box material. The cuts are made so that when the material is folded a rectangular shaped box, open on one major face, is obtained. The corners of the box may be glued, stapled, or locked by a conventional folding tab and slot arrangement. The method of cutting and folding the container parts is not critical, except that the upper and lower parts must be able to slide together or otherwise engage to bring conductive layers 23 and 24 into contact. Generally, there must be sufficient overlap 33 between lower part 21 and upper part 22, or another contact means must be provided, so that outer conductive coating 23 and inner conductive coating 24 make good electrical contact with each other. The proper amount of over-lap or engagement of the two conductive coated surfaces 25, 26 can be readily determined by experiment.

While the terms "upper" and "lower" have been used to describe the present invention, it will be readily apparent that these terms are merely relative and that they can be interchanged. This is illustrated by turning FIG. 2B by 180°. Inverting container 20 in this fashion has the advantage that any objects placed at 29 within container 20 rest directly on conductive layer 24 on inner surface 26 of part 22.

Thus, it is apparent that there has been provided in accordance with this invention, an improved container for handling, storaging, and shipping charge sensitive devices; that the improved container uses materials which need only be one-side coated, thus using less conductive ink; that the container readily separates into two parts for ease of access; that the container has its conductive shield exposed on one exterior surface so it may be readily grounded; that only one exterior surface of the assembled container need carry a conductive layer, thus leaving the remaining exterior surfaces free for advertising, decorative printing, and/or identification purposes; and that when upper and lower parts of the container are joined, a closed conductive shield is formed around the contents.

Having thus described the invention, it will be apparent to those skilled in the art that various modifications can be made within the spirit and scope of the present invention. Accordingly, it is intended to encompass all such modifications.

We claim:

1. A two part electrostatic shielded container formed from material having a conductive coating only on one side, comprising:

a first container part open on one side, and having said conductive coating facing outward;

a second container part open on one side, adapted to slide over said first part, and having said conductive coating facing inward.

2. A container adapted to electrostatic shielding of objects placed therein, comprising:

a first separable container portion having an electrically conductive means only on an outer surface;

a second separable container portion, larger than said first separable container portion, and having an electrically conductive means only on an inner surface; and wherein said second separable container portion is adapted to engage said first separable container portion so that said outer surface of said first separable container portion is in contact with said inner surface of said second separable container portion.

3. A two part electrostatic shielded shipping, handling, and storage container, comprising:

a first part forming an open box, having an inner surface and an outer surface, and wherein only a first of said inner and outer surfaces of said first part is conductive;

a second part separate from said first part, forming an open box adapted to slideably engages said first part, having an inner surface and an outer surface, wherein only a second of said inner and outer surfaces of said second part is conductive; and wherein said first and second surfaces are of unlike kine, one being an inner surface and the other an outer surface.

4. A two part handling, shipping, and storage container adapted to provide a conductive cage for electrostatically shielding objects placed therein, comprising:

a first part formed from a first dielectric material, open on one side, and having a first conductive surface coating only on an outward facing surface;

a second part formed from a second dielectric material, open on one side, and having a second conductive surface coating only on an inward facing surface;

wherein said first part is adapted to slideably engage said second part thereby forming said container; and wherein, when said first part engages said second part, said first conductive surface coating contacts said second conductive surface coating, thereby enclosing objects placed within said container in said conductive cage formed from the combination of said first and second conductive surface coating.

* * * * *

UNITED STATES PATENT AND TRADEMARK OFFICE

CERTIFICATE OF CORRECTION

PATENT NO. : 4,480,747

DATED : November 6, 1984

INVENTOR(S) : THOMAS R. KAZOR and JON P. WHITCOMB

It is certified that error appears in the above-identified patent and that said Letters Patent is hereby corrected as shown below:

Column 6, claim 3, line 18, change "kine" to --kind--.

Signed and Sealed this

*Thirtieth* Day of *April 1985*

[SEAL]

*Attest:*

DONALD J. QUIGG

*Attesting Officer* *Acting Commissioner of Patents and Trademarks*